US005749744A

United States Patent [19]

Henderson et al.

[11] Patent Number: 5,749,744

[45] Date of Patent: May 12, 1998

[54] ELECTRICAL CONNECTOR WITH EMI/RFI SHIELDING

[76] Inventors: Brent E. Henderson, R.R. 1, Box 1A, Golden, Ill. 62339; Pat A. Bolen, 914 Main St., Carthage, Ill. 62321; John A. DeFranco, 29733 Deer Run, Farmington, Mich. 48331

[21] Appl. No.: 671,261

[22] Filed: Jun. 26, 1996

[51] Int. Cl.[6] ..... H01R 3/00

[52] U.S. Cl. ..... 439/164; 439/15

[58] Field of Search ..... 439/164, 15, 13

[56] References Cited

U.S. PATENT DOCUMENTS

| | | | |
|---|---|---|---|
| 4,722,690 | 2/1988 | Priede | 439/15 |
| 4,797,109 | 1/1989 | Wende | 439/15 |
| 5,061,195 | 10/1991 | Bolen | 439/164 |
| 5,171,157 | 12/1992 | Bolen | 439/164 |
| 5,429,508 | 7/1995 | Brevick | 439/15 |
| 5,429,517 | 7/1995 | Bolen | 439/164 |
| 5,460,535 | 10/1995 | Bolen | 439/164 |
| 5,487,667 | 1/1996 | Bolen | 439/164 |
| 5,490,793 | 2/1996 | Bolen | 439/164 |

*Primary Examiner*—Khiem Nguyen
*Assistant Examiner*—Eugene G. Byrd
*Attorney, Agent, or Firm*—David L. Newman

[57] ABSTRACT

An electrical connector such as a clockspring for carrying electrical signals through a steering wheel provides EMI/RFI shielding. The electrical connector includes a housing formed of a conductive plastic and/or a metallized exterior surface.

8 Claims, 1 Drawing Sheet

ELECTRICAL CONNECTOR WITH EMI/RFI SHIELDING

BACKGROUND OF THE INVENTION

The present invention relates to an electrical connector having EMI/RFI shielding. In particular, a clockspring which electrically connects a stationary housing to a rotatable hub by means of a flat ribbon cable is provided formed of a conductive plastic or shielded housing.

Clocksprings are typically used in applications such as connecting an air bag, mounted in the steering wheel of an automobile, to sensors mounted within various locations of the automobile.

For example, U.S. Pat. No. 5,061,195 (1991), issued to Bolen, discloses a type of clockspring providing a direct electrical connection between relatively movable members in the steering apparatus of an automobile. In this type of clockspring construction, a ribbon cable is used to provide the electrical connection. The ribbon cable is constructed of conductive material which is sandwiched between two layers of mylar. The cable is loosely accommodated in a coiled state within the clockspring's housing. In addition, one end of the cable is attached to the clockspring's stationary member and the other end of the cable is attached to the clockspring's rotatable hub.

Clocksprings are being used in environments where radio frequency interference (RFI) and electromagnetic interference (EMI) is increasing such as in automobiles or heavy trucks where devices such as CBs, radar detectors, radios and global positioning devices emit RFI and EMI. As a result of the excessive amount of interference that may be generated in the passenger compartment of a vehicle, a standard clockspring is not sufficient to enough to "choke" all the interference created by the electronic devices and, therefore, a shielding mechanism is necessary to prevent the airbag from deploying. Due to the spiral nature of the flat conductor cable of a clockspring, the electrical conductors are susceptible to such EMI/RFI interference and may cause false signals resulting in the harmful deployment of an airbag.

Therefore, it is an object of the present invention to provide a shielded clockspring in order to prevent RFI/EMI.

It is a further object of the present invention to provide for an electrical connector which may quickly and easily be assembled having RFI/EMI shielding.

SUMMARY OF THE INVENTION

The present invention provides a clockspring for carrying electrical signals through a steering wheel comprising a housing having an outer radial wall and a top formed of conductive plastic, a hub rotatably mounted to the housing formed of a conductive plastic and a ribbon cable coiled around the hub and connected to the housing and the hub wherein the ribbon cable is shielded from EMI/RFI. The conductive plastic may include stainless steel fibers. The housing may include an outer radial wall and bottom formed of conductive plastic. The hub may include a top and bottom formed of conductive plastic.

In an embodiment, an electrical connector is provided for carrying electrical signals through a steering wheel comprising a housing having an outer radial wall and a top having an outer metallized layer, a hub rotatably mounted to the housing having a top and bottom including an outer metallized layer and a ribbon cable coiled around the hub and connected to the housing and the hub wherein the ribbon cable is shielded from EMI/RFI. The metallized layer may be formed by plating on the surface of the housing. The metallized layer may be formed of a plastic metallic film. The metallized layer may be formed of a material having an adhesive backing and adhered to the outer surfaces of the housing of the clockspring.

Various means for practicing the invention and other advantages and novel features thereof will be apparent from the following detailed description of an illustrative preferred embodiment of the invention.

BRIEF DESCRIPTION OF THE DRAWING

There is shown in the drawing a presently preferred embodiment of the present invention, wherein like numerals in the various figures pertain to like elements, and wherein.

DETAILED DESCRIPTION OF THE PRESENTLY PREFERRED EMBODIMENTS

Figure 1:
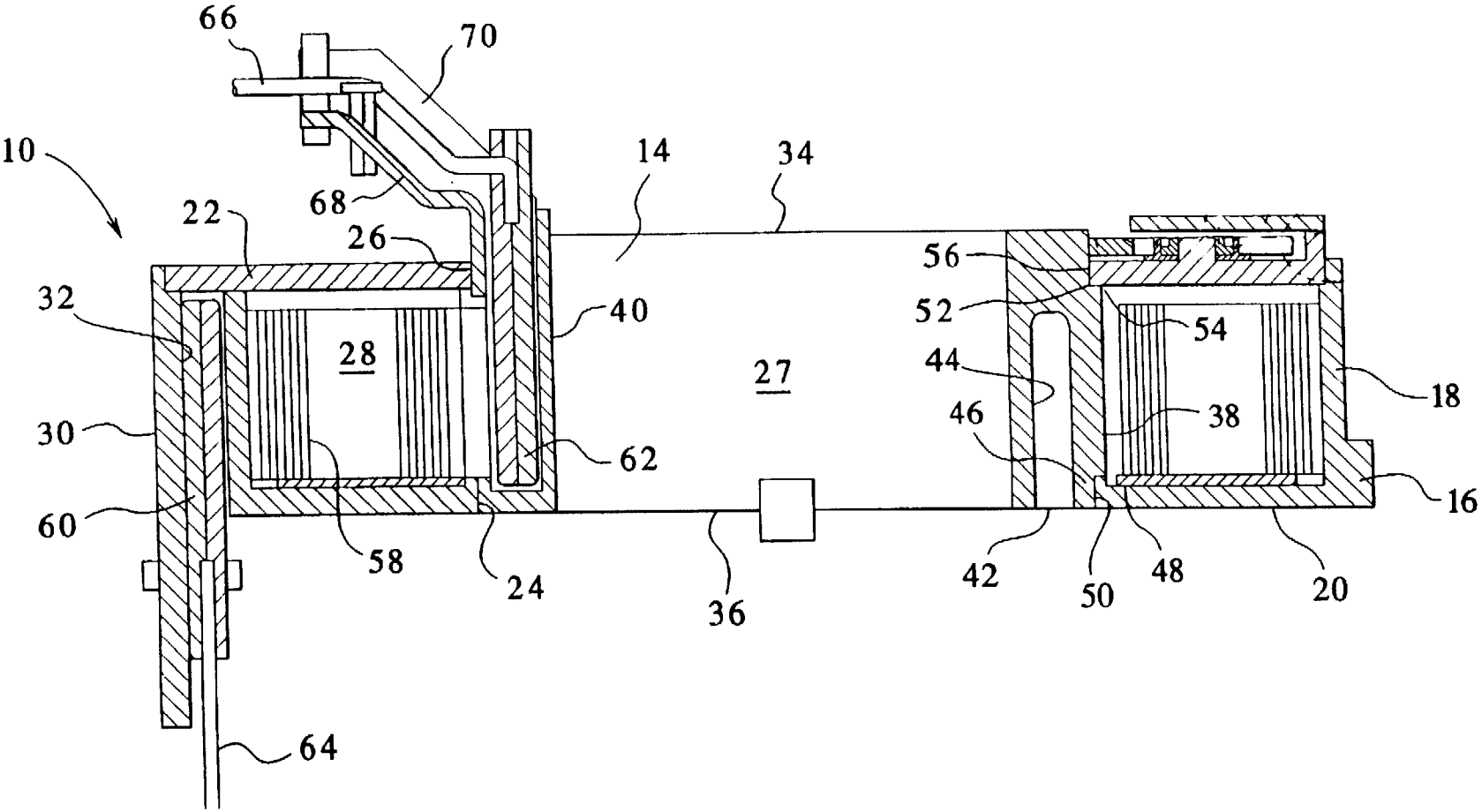
FIG. 1 is a cross-sectional side view of a clockspring employing EMI/RFI shielding.

Referring to FIG. 1, a cross-sectional view of an electrical connector 10 is depicted. In a preferred embodiment, the electrical connector is a clockspring for carrying electrical current through a steering assembly of a vehicle. The clockspring 10 comprises of a hub 14 and a housing 16. The housing 16 consists of an outer radial wall 18 which is perpendicularly attached to a base 20 and a top 22.

The base 20 of the housing 16 is generally circular in shape with a first aperture 24 located in its center. Likewise, the top 22 of the housing 16 is generally circular in shape with a second aperture 26 located in its center and the aperture 26 having a circumference equal to that of the first aperture 24. Together, the first aperture 24 and the second aperture 26 provide for a first central aperture 27 which extends through the housing 16 of the clockspring 10. In addition, the base 20, outer radial wall 18, and the top 22 of the housing 16 combine to define a circular channel 28 contained within the housing.

Extending outwardly from a portion of the outer radial wall 18 of the housing 16 is a partially extending radial wall 30. The extending radial wall 30 separates from the outer radial wall 18 so as to create a first connector containment cavity 32 within the housing 16. A passage (not shown) is provided between the first connector containment cavity 32 and the circular channel 28.

Rotationally mounted within the first central aperture 27 of the housing is the hub 14. The hub 14 includes a top 34, a bottom 36, and a second radial wall 38. Positioned within the center of the hub 14 is a second central aperture 40 which extends through the top 34 of the hub to the bottom 36 of the hub. In addition, situated within the bottom 36 of the second radial wall 38 is an opening 42 to a pin cavity 44 located within the second radial wall 38.

The second radial wall 38 of the hub 14 has an outer circumference which is greater than that of both the second aperture 26 and first aperture 24. Positioned between the second radial wall 38 and the bottom 36 of the hub 14 is a bottom race 46. The bottom race 46 has a lip 48 which extends inwardly and perpendicularly from the outside of the second radial wall 38 and adjoins to a bottom race wall 50. Correspondingly, the bottom race wall 50 extends perpendicularly from the lip 48 and advances to the bottom 36 of the hub 14. The bottom race wall 50 surrounds the hub 14 with a circumference equal to that of the first aperture 24 in the housing's base 20.

Likewise, situated between the second radial wall 38 and the top 34 of the hub 14 is a top race 52. The top race 52 has a lip 54 which extends inwardly and perpendicularly from the outside of the second radial wall 38 and abuts a top race wall 56. Correspondingly, the top race wall 56 extends perpendicularly from the lip 54 and advances to the top 34 of the hub 14. The top race wall 56 surrounds the hub 14 with a circumference equal to that of the second aperture 26 in the housing's top 22.

As previously stated, the clockspring's hub 14 is rotationally mounted within the first central aperture 27 of the housing 16. The top race wall 56 of the hub 14 slides within the second aperture 26 and against the top 22 of the housing 16. Likewise, the bottom race wall 50 slides within the first aperture 24 and against the base 20 of the housing 16. In addition, the second radial wall 38 of the hub 14 partially protrudes within the channel 28 of the housing 16. Therefore, the hub 14 is locked within the housing 16 because the portion of the second radial wall 38 which extends into the channel 28 has a larger circumference than both the first aperture 24 and the second aperture 26 of the housing 16.

Within the housing's channel 28 and surrounding the hub 14 is a coiled ribbon cable 58. The ribbon cable 58 has a first end and a second end. The first end of the ribbon cable 58 threads through the passage provided between the first connector containment cavity 32 and the channel 28. The first end of the cable 58 is conductively attached to a first connector 60 located within the cavity 32. The first connector 60 extends out of the cavity 32 and through the base 20 of the housing 16. Likewise, the second end of the ribbon cable 58 is conductively attached to a second connector 62. The second connector 62 mounts partially into the second radial wall 38 of the hub 14 and protrudes through the top 34 of the hub.

Extending from the first connector 60 to the outside of the clockspring 10 is a first wire harness 64. The first wire harness 64 is conductively attached to the first connector 60 and thus carries electrical signals to and from the coiled ribbon cable 58. Likewise, extending from the second connector 62 to the outside of the clockspring 10 is a second wire harness 66. The second wire harness 66 is conductively attached to the second connector 62 and thus carries electrical signals to and from the coiled ribbon cable 58.

Also extending from the top 34 of the hub 14 is a harness guide 68. The harness guide 68 is positioned adjacent to where the second connector 62 exits the hub 14. The harness guide 68 angles over the top 22 of the housing 16 and provides a channel 70 within which the harness 66 is positioned.

The housing 16 in a preferred embodiment is formed of a conductive plastic. Such a polymer material is manufactured by RTP, Inc. (Winnona, Minn.) with the trade name of EMI-261 H Series, EMI-361 H Series or EMI-661 Series and includes stainless-steel fibers which provide shielding for the clockspring 10 and grounds the clockspring housing 16. The conductive plastic provides for a faraday shield in order to protect the ribbon cable 58 from EMI/RFI. In a preferred embodiment, each part of the clockspring 10 which is molded of a polymer material will be molded with a conductive polymer material in order to provide the greatest amount of shielding. Such pieces molded of the conductive plastic would include the outer radial wall 18, the base 20, the second radial wall 38, bottom race 46, top race 52, the hub 14, the top of the hub 34, the bottom of the hub 36, the top of the housing 22 and the radial wall 30.

In an alternate embodiment, only certain portions of the housing 16 may be molded of conductive plastic where it is determined that limited shielding acts to reduce the RFI/EMI sufficiently to avoid a false triggering of the airbag. For example, only the housing base and top 20,22 may be formed of conductive plastic. However, any combination of the parts formed of conductive plastic may provide the proper shielding desired for this invention.

In a further alternate embodiment, the clockspring 10 may be shielded by other means such as by metallizing the outside of the housing 16, such as by plating the individual parts listed above. A further means of shielding may be provided by covering the housing 16 in a plastic film having conductive material therein or covering certain surfaces with a conductive material such as an aluminum foil composition having an adhesive backing.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A clockspring for carrying electrical signals through a steering wheel comprising:

a housing having an outer radial wall and a top formed of conductive plastic;

a hub rotatably mounted to the housing formed of conductive plastic; and a ribbon cable coiled around the hub and connected to the housing and the hub, wherein the ribbon cable is shielded from EMI/RFI.

2. The clockspring of claim 1, wherein the conductive plastic includes stainless-steel fibers.

3. The clockspring of claim 1, wherein the housing further includes an outer radial wall and a bottom formed of conductive plastic.

4. The clockspring of claim 1, wherein the hub includes a top and bottom formed of conductive plastic.

5. An electrical connector for carrying electrical signals through a steering wheel comprising:

a housing have an outer radial wall and a top having an outer metallized layer;

a hub rotatably mounted to the housing having a top and bottom, including an outer metallized layer; and a ribbon cable coiled around the hub and connected to the housing and the hub, wherein the ribbon cable is shielded from EMI/RFI.

6. The clockspring of claim 5 wherein the metallized layer is formed by plating on the surface of the housing.

7. The clockspring of claim 5 wherein the metallized layer is formed of a plastic metallic film.

8. The clockspring of claim 5 wherein the metallized layer is formed of a material having an adhesive backing and adhered to the outer surfaces of the housing of the clockspring.

* * * * *